US010448167B2

(12) United States Patent
Xiao et al.

(10) Patent No.: US 10,448,167 B2
(45) Date of Patent: Oct. 15, 2019

(54) ACOUSTIC DEVICE

(71) Applicant: AAC Technologies Pte. Ltd., Singapore (SG)

(72) Inventors: Bo Xiao, Shenzhen (CN); Ronglin Linghu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/234,759

(22) Filed: Dec. 28, 2018

(65) Prior Publication Data

US 2019/0238988 A1 Aug. 1, 2019

(30) Foreign Application Priority Data

Jan. 27, 2018 (CN) ..... 2018 2 0143970 U

(51) Int. Cl.

| | |
|---|---|
| ***H04R 9/06*** | (2006.01) |
| ***H04R 1/06*** | (2006.01) |
| ***H04R 9/02*** | (2006.01) |
| ***H04R 7/18*** | (2006.01) |
| ***H04R 3/00*** | (2006.01) |

(52) U.S. Cl.

CPC ..... *H04R 9/06* (2013.01); *H04R 1/06* (2013.01); *H04R 3/00* (2013.01); *H04R 7/18* (2013.01); *H04R 9/025* (2013.01); *H04R 2400/11* (2013.01)

(58) Field of Classification Search

CPC . H04R 3/00; H04R 9/06; H04R 9/025; H04R 1/06; H04R 2400/11; H04R 7/18

USPC ..... 381/117

See application file for complete search history.

(56) References Cited

U.S. PATENT DOCUMENTS 9,154,884 B2 * 10/2015 Yan ..... H04R 9/025

* cited by examiner

*Primary Examiner* — Paul Kim

(74) *Attorney, Agent, or Firm* — IPro, PLLC; Na Xu

(57) ABSTRACT

The present disclosure provides an acoustic device, including a frame and a vibration system fixed to the frame, where the vibration system includes a first vibrating diaphragm fixed to the frame, a voice coil driving the first vibrating diaphragm to vibrate and produce a sound, and a flexible circuit board, the flexible circuit board is fixed to an end of the voice coil which is away from the first vibrating diaphragm, the flexible circuit board includes a first fixing arm and a second fixing arm respectively fixed to the frame and the voice coil body, an elastic arm connecting the first fixing arm and the second fixing arm, and a pad respectively extending from two ends of the second fixing arm, the pad is at least partially located on an inner side of the voice coil body. The acoustic device in the present disclosure has better acoustic performance.

3 Claims, 2 Drawing Sheets

ACOUSTIC DEVICE

CROSS-REFERENCE TO RELATED APPLICATIONS

This application claims the priority benefit of Chinese Patent Application Ser. No. 201820143970.0 filed on Jan. 27, 2018, the entire content of which is incorporated herein by reference.

TECHNICAL FIELD

The present disclosure relates to the electroacoustic field, and in particular, to an acoustic device applied to a portable electronic product.

BACKGROUND

With the arrival of the Internet age, the quantity of smart mobile devices gradually increases. In various mobile devices, mobile phones are doubtlessly the most common and portable mobile terminal devices. Acoustic devices for playing audio are widely applied to smart mobile devices such as mobile phones.

A vibration system and a magnetic circuit system that are applied to an acoustic device directly affect the acoustic quality of the acoustic device. To improve stability of the vibration system, a vibration system of a micro acoustic device in the related art includes a first vibrating diaphragm fixed to a frame and used to vibrate and produce a sound, a second vibrating diaphragm used to improve transverse stability of a voice coil, and a flexible circuit board.

The second vibrating diaphragm is attached and fixed to the flexible circuit board, to form a combined flexible circuit board-vibrating diaphragm structure, used to connect to a voice coil lead wire to input an electrical signal, and avoid a problem that the voice coil lead wire breaks due to vibration of the vibration system especially in large power and large amplitude cases. The flexible circuit board includes two fixing arms respectively fixed to the frame and the voice coil and an elastic arm connecting the two fixing arms. The second vibrating diaphragm includes two fixing portions respectively fixed to the two fixing arms and a vibration portion connecting the two fixing portions. The voice coil lead wire of the voice coil is electrically connected to the flexible circuit board.

However, in the related art, the voice coil lead wire extends outwards from a voice coil body, and is spot welded on the flexible circuit board. The structure occupies space due to a spot welding position at a connection portion between the voice coil lead wire and the flexible circuit board, and therefore, occupies vibration space of the vibration portion of the second vibrating diaphragm. When a total height is specified, the vibration space of the second vibrating diaphragm is limited, thereby affecting the acoustic performance of the acoustic unit.

Therefore, it is desired to provide a new acoustic device to resolve the foregoing technical problem.

BRIEF DESCRIPTION OF THE DRAWINGS

To illustrate the technical solutions in the embodiments of the present disclosure, the following briefly describes the accompanying drawings required for describing the embodiments. Apparently, the accompanying drawings in the following description merely show some embodiments of the present disclosure, and persons of ordinary skill in the art can derive other drawings from these accompanying drawings without creative efforts.

DETAILED DESCRIPTION

The technical solutions of embodiments of the present disclosure are described clearly and completely in the following with reference to the accompanying drawings in the embodiments of the present disclosure. Apparently, the described embodiments are merely some embodiments of the present disclosure, rather than all embodiments. All other embodiments obtained by a person of ordinary skill in the art based on the embodiments of the present disclosure without creative efforts shall fall within the protection scope of the present disclosure.

Figure 1:
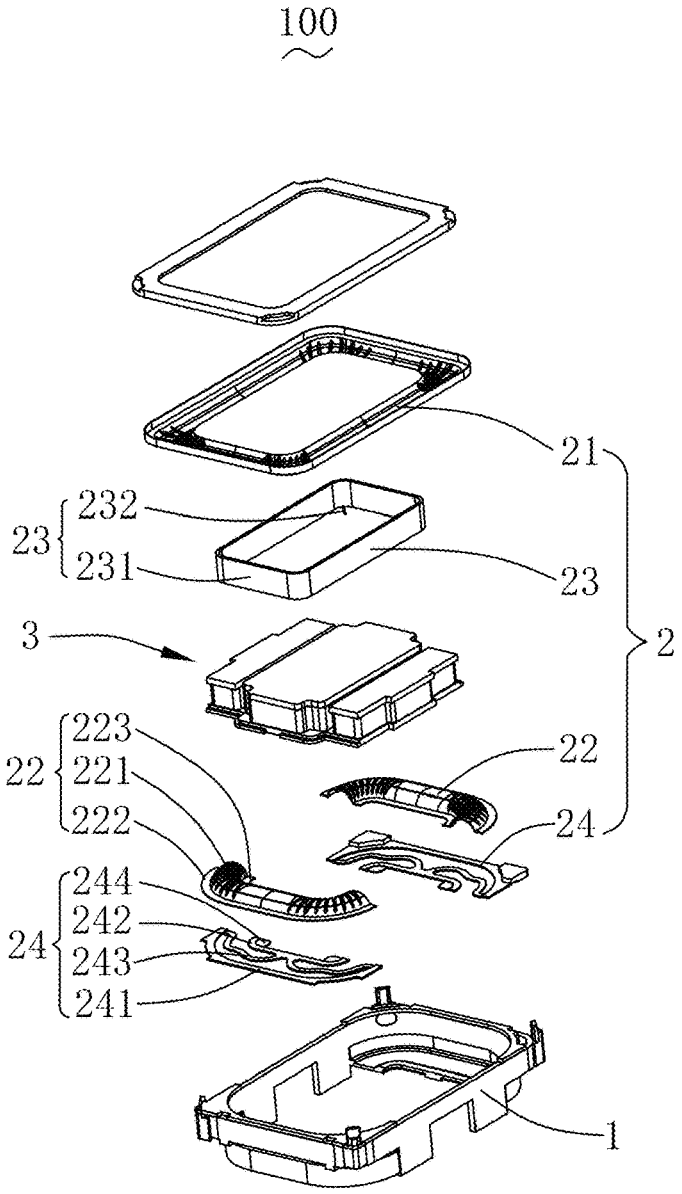
FIG. 1 is a schematic exploded view of a three-dimensional structure of an acoustic device according to the present disclosure.
Figure 2:
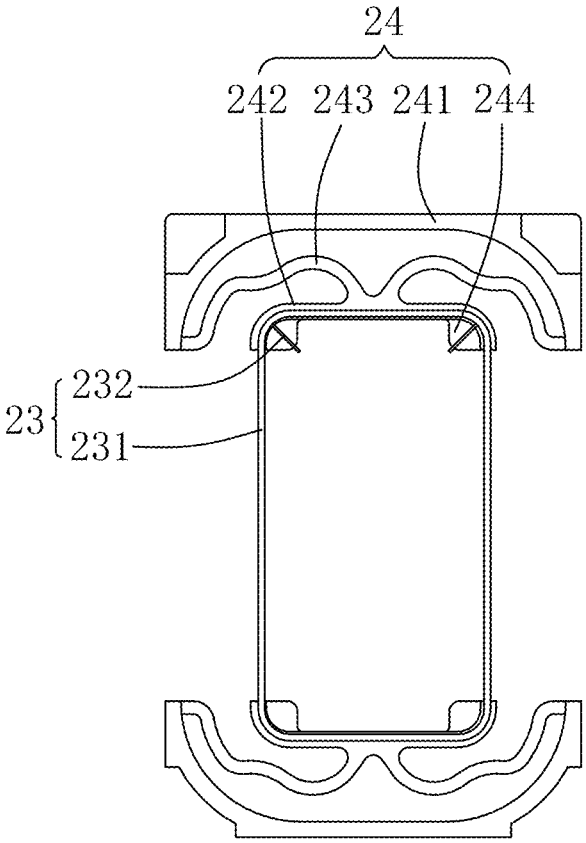
FIG. 2 is a schematic structural diagram showing that a second vibrating diaphragm of an acoustic device is assembled to a flexible circuit board according to the present disclosure.

Referring to FIG. 1 and FIG. 2, the present disclosure provides an acoustic device 100, including a frame 1, a vibration system 2 fixed to the frame 1, and a magnetic circuit system 3 driving the vibration system 2 to vibrate.

The vibration system 2 includes a first vibrating diaphragm 21 and a second vibrating diaphragm 22 that are respectively fixed to the frame 1, a voice coil 23 driving the first vibrating diaphragm 21 to vibrate and produce a sound, and a flexible circuit board 24.

The voice coil 23 includes a voice coil body 231 and a voice coil lead wire 232 extending from the voice coil body 231. The voice coil body 231 is fixed to the first vibrating diaphragm 21 and drives the first vibrating diaphragm 21 to vibrate and produce a sound.

In this embodiment, the voice coil lead wire 232 extends from the voice coil body 231 towards an inner side of the voice coil body 231. For example, the voice coil body 231 is rectangular, and the voice coil lead wire 232 extends from two neighboring corners of the voice coil body 231 toward the inner side of the voice coil body 231.

The flexible circuit board 24 is fixed to an end of the voice coil 23 which is away from the first vibrating diaphragm 21.

In this embodiment, the flexible circuit board 24 includes a first fixing arm 241, a second fixing arm 242 spaced apart from the first fixing arm 241, an elastic arm 243 connecting the first fixing arm 241 and the second fixing arm 242, and a pad 244 extending from two ends of the second fixing arm 242.

The first fixing arm 241 and the second fixing arm 242 are respectively fixed to the frame 1 and the voice coil body 231.

The elastic arm 243 may be bent and of a wave shape, or of a plurality of successive "S" shape. That is, the elastic arm 243 is of a bent/curved structure, so that the length of the elastic arm 243 is as long as possible, thereby improving the vibration performance and the anti-breaking performance thereof, and improving the acoustic performance and the reliability of the acoustic device 100.

The pad 244 is at least partially located on the inner side of the voice coil body 231. The voice coil lead wire 232 extends from the voice coil body 231 toward the inner side of the voice coil body 231 and is fixed to the pad 244 to form an electrical connection.

Specifically, the voice coil lead wire 232 is fixed to the pad 244 through welding, and the welding manner has good reliability. It should be noted that there are two voice coil lead wires 232, including a positive lead and a negative lead, and there are also two corresponding pads 244, which can be easily figured out by a person skilled in the art.

The second vibrating diaphragm 22 is fixed to a side of the voice coil body 231 which is away from the first vibrating diaphragm 21. Specifically, the second vibrating diaphragm 22 includes a vibration portion 221 and a first fixing portion 222 and a second fixing portion 223 that respectively extend from two opposite sides of the vibration portion 221.

The first fixing portion 222 is fixed to the first fixing arm 241, and the second fixing portion 223 is fixed to the second fixing arm 242. In this embodiment, the vibration portion 221 is of an arc structure protruding toward the first vibrating diaphragm 21.

On one hand, in the structure in which the voice coil lead wire 232 is guided by the flexible circuit board 24, the voice coil lead wire 232 is directly guided to an external power source by using the flexible circuit board 24, thereby avoiding a problem of low reliability of the acoustic device 100 caused due to a breaking risk of the voice coil lead wire 232. On the other hand, the second vibrating diaphragm 22 avoids swing due to vibration of the voice coil 23 and improves the vibration performance of the vibration system 2, so that the acoustic device 100 has better stability and better acoustic performance such as sound intensity.

Arrangements of the foregoing structure enable that a fixing and welding position between the voice coil lead wire 232 and the pad 244 of the flexible circuit board 24 is on the inner side of the voice coil body 231, thereby avoiding occupying the vibration space of the flexible circuit board 24 and of the second vibrating diaphragm 22, effectively increasing vibration amplitude ranges of the flexible circuit board 24 and the second vibrating diaphragm 22 when the size of the acoustic device 100 remains unchanged, where amplitudes can be increased from 0.35 mm to 0.45 mm, improving the vibration performance of the vibration system 2, effectively improving the acoustic performance of the acoustic device 100, and moreover, removing an assembling limitation by a spot welding position of the pad 244 to the amplitude improvement of the vibration system 2.

In this embodiment, the flexible circuit board 24 may be embedded in the second vibrating diaphragm 22, or may be attached and fixed to a surface of the second vibrating diaphragm 22, so that the second vibrating diaphragm 22 and the flexible circuit board 24 form a combined flexible circuit board-vibrating diaphragm structure. These are all feasible.

In this embodiment, the frame 1 is rectangular. There are two flexible circuit boards 24, and the two flexible circuit boards 24 are respectively located on two shorter opposite sides of the frame 1. There are two second vibrating diaphragms 22, and the two second vibrating diaphragms 22 are respectively fixed to the two flexible circuit boards 24 and are centrally symmetrical with respect to the voice coil body 231. The symmetrical structure makes the vibration stability and the reliability of the vibration system 2 better.

The two second vibrating diaphragms 22 are disposed in a segment manner and are symmetrical. On one hand, space is saved. On the other hand, the anti-swing performance of the voice coil 23 is improved, and the acoustic performance and the reliability of the acoustic device 100 are improved.

Compared with the related art, in the present disclosure, the acoustic device is provided with the flexible circuit board fixed to a side of the voice coil which is away from the first vibrating diaphragm, thereby avoiding an influence to the vibration performance of the voice coil which is caused by transverse swing during vibration of the voice coil, enhancing the vibration intensity of the voice coil, and improving the acoustic performance of the acoustic device. The voice coil lead wire extends from the voice coil body to the inner side of the voice coil body. Moreover, the pad disposed on the flexible circuit board extends to an inner side of the voice coil and is fixedly electrically connected to the voice coil lead wire, so that welding between the voice coil lead wire and the pad does not occupy the vibration space of the flexible circuit board and of the second vibrating diaphragm, thereby improving vibration amplitudes of the flexible circuit board and the second vibrating diaphragm, further improving the vibration performance of the vibration system, and effectively improving the acoustic performance of the acoustic device.

The foregoing descriptions are merely embodiments of the present disclosure. It should be noted that a person of ordinary skill in the art can make improvements without departing from the inventive concept of the present disclosure, and all the improvements shall fall within the protection range of the present disclosure.

What is claimed is:

1. An acoustic device, comprising a frame and a vibration system fixed to the frame, wherein the vibration system comprises a first vibrating diaphragm fixed to the frame, a voice coil driving the first vibrating diaphragm to vibrate and produce a sound, and a flexible circuit board, the flexible circuit board is fixed to an end of the voice coil which is away from the first vibrating diaphragm, the voice coil comprises a voice coil body and a voice coil lead wire extending from the voice coil body and electrically connected to the flexible circuit board, the flexible circuit board comprises a first fixing arm and a second fixing arm respectively fixed to the frame and the voice coil body, an elastic arm connecting the first fixing arm and the second fixing arm, and a pad respectively extending from two ends of the second fixing arm, the pad is at least partially located on an inner side of the voice coil body, and the voice coil lead wire extends from the voice coil body toward the inner side of the voice coil body and is fixed to the pad to form an electrical connection;

wherein the vibration system further comprises a second vibrating diaphragm fixed to the flexible circuit board, the second vibrating diaphragm comprises a vibration portion and a first fixing portion and a second fixing portion respectively extending from two opposite sides of the vibration portion, the first fixing portion is fixed to the first fixing arm, and the second fixing portion is fixed to the second fixing arm;

wherein the frame is rectangular, there are two flexible circuit boards, and the two flexible circuit boards are respectively located on two shorter opposite sides of the frame; and wherein there are two second vibrating diaphragms, and the two second vibrating diaphragms are respectively fixed to the two flexible circuit boards and are symmetrically disposed about the voice coil body.

2. The acoustic device according to claim 1, wherein the vibration portion is of an arc structure protruding toward the first vibrating diaphragm.

3. The acoustic device according to claim 1, wherein the voice coil lead wire is fixed to the pad through welding.

* * * * *